US007469426B2

(12) United States Patent
Roeckl

(10) Patent No.: US 7,469,426 B2
(45) Date of Patent: Dec. 30, 2008

(54) GLOVE

(76) Inventor: Stefan Roeckl, Walchstadter Höhe 7, 82057 Icking (DE)

( * ) Notice: Subject to any disclaimer, the term of this patent is extended or adjusted under 35 U.S.C. 154(b) by 0 days.

(21) Appl. No.: 10/878,813

(22) Filed: Jun. 28, 2004

(65) Prior Publication Data

US 2005/0028244 A1 Feb. 10, 2005

(51) Int. Cl.
*A41D 19/00* (2006.01)

(52) U.S. Cl. ..... 2/161.6; 2/16

(58) Field of Classification Search ..... 2/16, 2/20, 159, 160, 161.1, 161.2, 161.6, 163, 2/169, 21, 161.3
See application file for complete search history.

(56) References Cited

U.S. PATENT DOCUMENTS

| | | | | | |
|---|---|---|---|---|---|
| 1,673,517 | A * | 6/1928 | Kurz | 2/161.8 |
| 2,582,240 | A * | 1/1952 | Dumas | 2/161.1 |
| 2,907,046 | A * | 10/1959 | Scherr | 2/159 |
| 4,123,803 | A * | 11/1978 | Rinehart | 2/163 |
| 4,769,856 | A * | 9/1988 | Reed | 2/167 |
| 4,779,289 | A * | 10/1988 | Prouty | 2/16 |
| 4,894,866 | A * | 1/1990 | Walker | 2/161.6 |
| 5,168,578 | A * | 12/1992 | Stanley | 2/19 |
| 5,604,934 | A * | 2/1997 | Willett | 2/161.1 |
| 5,675,839 | A * | 10/1997 | Gordon et al. | 2/159 |
| 5,697,104 | A * | 12/1997 | Welton | 2/159 |
| 5,987,642 | A * | 11/1999 | Webster | 2/19 |
| 6,289,517 | B1 * | 9/2001 | Minkow et al. | 2/161.1 |
| 6,427,246 | B1 * | 8/2002 | Doi et al. | 2/161.1 |
| 6,496,984 | B1 * | 12/2002 | Chow | 2/16 |
| 6,721,960 | B1 * | 4/2004 | Levesque et al. | 2/161.1 |
| 6,760,924 | B2 * | 7/2004 | Hatch et al. | 2/161.5 |
| 2003/0070204 | A1 * | 4/2003 | Summers | 2/16 |

FOREIGN PATENT DOCUMENTS

| | | |
|---|---|---|
| WO | WO 02/058493 | 8/2002 |

* cited by examiner

*Primary Examiner*—Katherine Moran

(57) ABSTRACT

Disclosed is a glove (1, 10), in particular a bicycle glove, with a thumb (5) and a forefinger (6). To improve such a glove so that pressure spots are avoided during usage of the glove it is proposed to fasten a padding (7*a*, 17*a*) in the region of grip-load of the thumb crotch (B) between the thumb (5) and the finger (6).

16 Claims, 2 Drawing Sheets

GLOVE

This application claims the benefit of Registered German Utility Model Serial No. DE 203 10 088, filed Jul 1, 2003.

FIELD OF THE INVENTION

The invention relates to a glove, and on particular to a bicycle glove, according to the characterizing portion of claim 1.

BACKGROUND

There exists a great number of this kind of gloves in the market. As regards the region of the thumb crotch such gloves are usually produced on the basis of two basic patterns; according to a first alternative upon the simple two-dimensional pattern and according to a second alternative upon the three-dimensional pattern. With the two-dimensional pattern the inner parts and the outer parts of the glove are each tailored to the desired size, laid upon each other and sewed together in the region of the thumb crotch along the cut selvedges. By doing so there are formed rising multi-layers of the material of the glove between thumb and forefinger, which in particular with close gloves or with gloves which are intended for a firm grip, as is e.g. the case with bicycle gloves, may result in pressure spots. Therefore, by the three-dimensional pattern it was attempted to relocate the seams out of these sensitive regions. When applying the three-dimensional pattern the front side and the back side of the glove are tailored smaller than necessary and in the region between thumb and forefinger strip-like elements, called trims, are arranged. Between the fingers these elements are usually fastened by means of an inseam. Between the thumb and the forefinger, at least at the inner side of the hand, the element is fastened by means of a lapping seam, i.e. a seam by which the material is laid right-side onto left-side and is stitched onto each other in an area-like manner, so that in the region of this seam only a double layer of the materials exist. Nevertheless, this seam may still interfere and may cause pressure spots, respectively.

SUMMARY

It is, therefore, an object of the present invention to provide a glove with an improved protection against pressure spots between thumb and forefinger.

This object is solved by the features according to the claims.

The development of the invention provides in a surprisingly simple manner a qualitatively clearly improved protection against pressure spots for that region of the thumb crotch which is particularly stressed when an item is encompassed, and a substantial increase in comfort.

Advantageous embodiments may be gathered from the subclaims. It is particularly suitable to cover the thumb-seam by a padding for the ball of the thumb, wherein the padding extends across the region of the thumb-seam, as by that a contiguous padding for the regions of the hand is provided which—in particular with bicycle gloves—are heavily stressed. By that the position of the grip of the hand at the handle bar of the bicycle may be changed depending on the acclivity of the road or on the sitting or standing position of the cyclist on the pedals, without the danger that the usually hard handle bar pushes displeasingly onto the sensitive region of the thumb crotch, and—as the case may be—that this punctual pressure load will further be increased by the glove-seams within this region.

The present invention may be applied to any glove-pattern, however, that glove-pattern disclosed in the claims is preferred.

BRIEF DESCRIPTION OF THE DRAWINGS

Embodiments of the present invention will be illustrated in the following by the drawings.

DETAILED DESCRIPTION OF THE INVENTION

Figure 2:
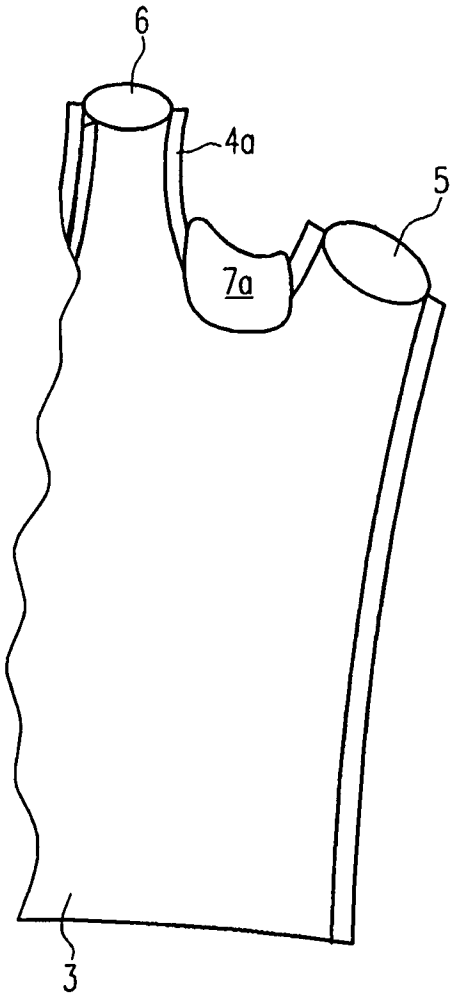
FIG. 2 is a partial view of the glove of FIG. 1, in a view onto the back side of the hand.
Figure 1:
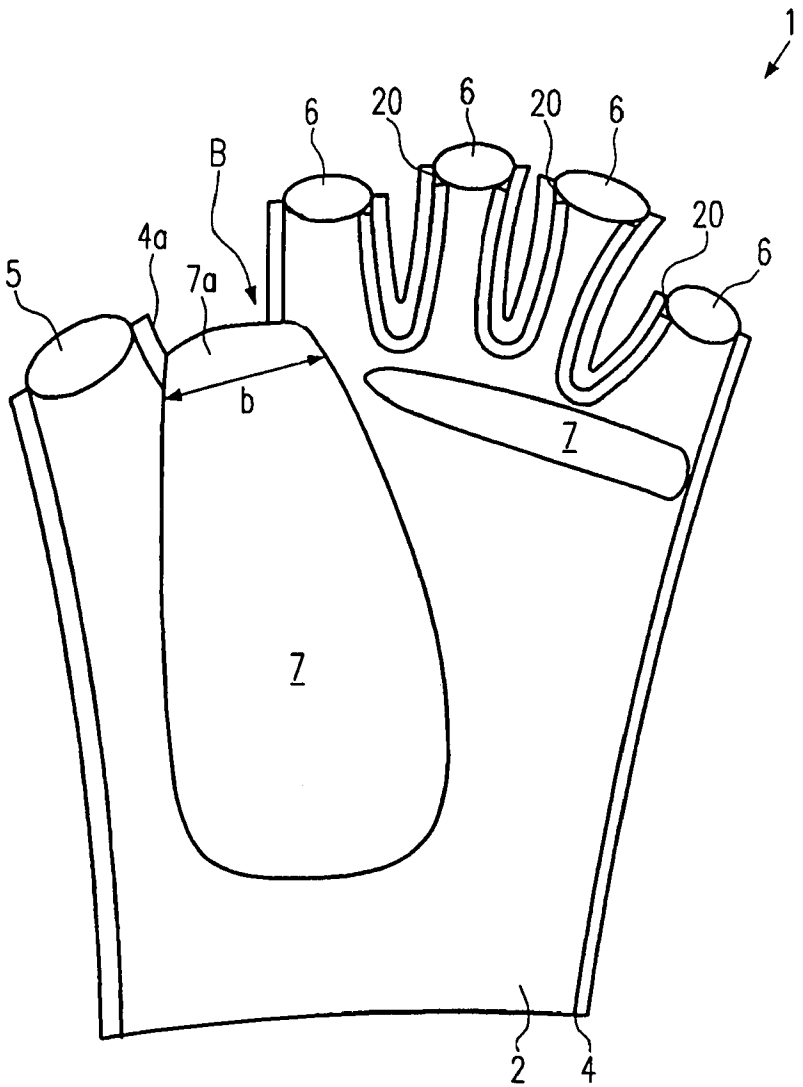
FIG. 1 is a plan view onto an inner side of a hand of a half-finger bicycle glove according to the invention put over outside-in provided as a first embodiment.

FIGS. 1 and 2 show a first embodiment of a glove 1 according to the invention, which is represented put over outside-in. According to the illustrated embodiment glove 1 is formed as a half-finger bicycle glove. In the region of the thumb crotch glove 1 is produced by a two-dimensional pattern, i.e. glove 1 comprises a cutting for the inner side 2 of the hand and a cutting for the back side 3 of the hand and further cuttings, such as e.g. trims 20, i.e. intermediate pieces for the fingers, which are cut out from the usual materials for gloves, which are usually laid onto each other right-side onto right-side (i.e. with those sides visible on a later stage) and which will be fastened to each other with a safety distance to the cut selvedges via inseams 4 so that a thumb 5 and fingers 6 are formed. With a two-dimensional pattern the inseam 4 is provided for as a single thumb-seam 4*a* in the thumb crotch B and between the thumb 5 and the adjacent forefinger 6.

On the inner side 2 of the hand the usual padding 7 made of usual padding materials like foamed material, gel, latex, rubber or mixtures or combinations thereof is arranged, wherein that part of the padding 7 which pads the ball of the thumb seamlessly extends into the thumb crotch B and is laid across the thumb-seam 4*a* up to and onto the back side 3 of the hand, as is in particular illustrated in FIG. 2. The padding 7 with the region 7*a* may be arranged at the inner side of the glove 1 and may optionally be covered by a lining having the size of the padding material or by a complete glove-lining.

The size of the region 7*a* of the padding which extends across the thumb-seam 4*a* to the back side 3 of the hand should be chosen sufficient in size so that the padding 7*a*—regardless of the position of the grip—is always positioned between the hand of the wearer and the handle. In the region of the thumb crotch B the padding 7*a* should have such a width b and should be arranged such that the region of grip-load, i.e. that region of the thumb crotch B which abuts on an object during a grip, is covered, but that the mobility of the thumb is not reduced and that there is no additional formation of wrinkles. Preferably the padding 7*a* covers in the direction of the width b the curvature of the thumb crotch B from a position at or below of the base of the forefinger to the base of the thumb.

Figure 4:
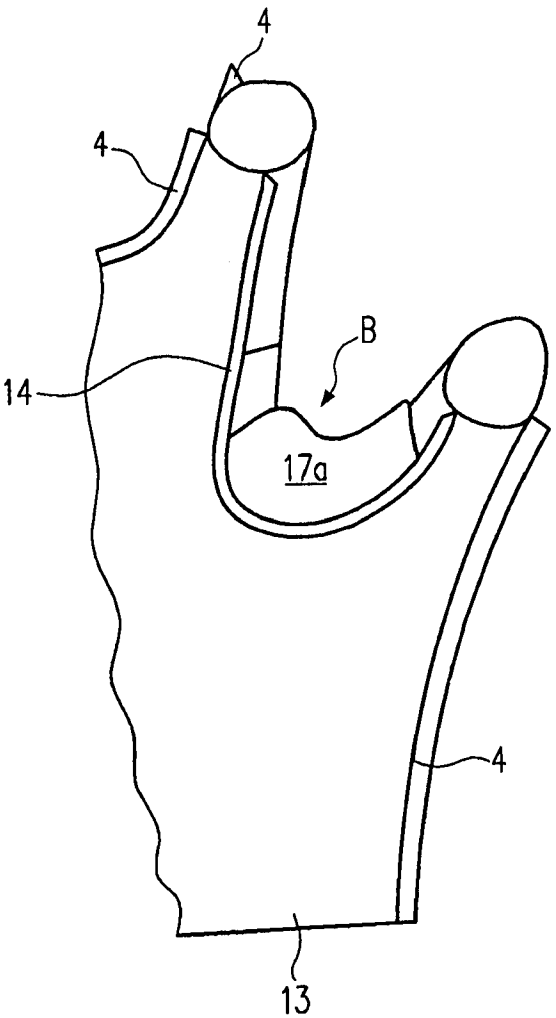
FIG. 4 is a view similar to FIG. 2 onto the embodiment of FIG. 3.
Figure 3:
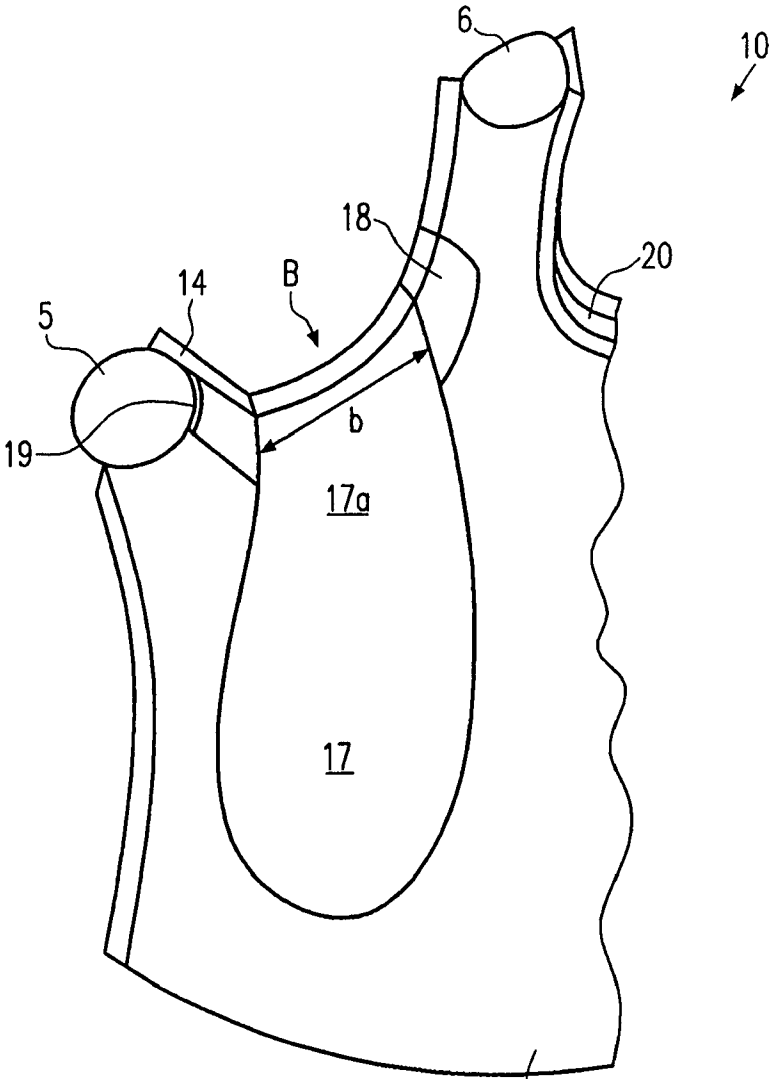
FIG. 3 is a view similar to FIG. 1 of another embodiment of a glove according to the invention.

FIGS. 3 and 4 illustrate another embodiment of a glove 10 according to the invention, which is represented within the figures put over outside-in and is formed as a half-finger bicycle glove. The glove 10 is produced between thumb and forefinger by a three-dimensional pattern, too, and contains a cutting for an inner side 12 of the hand and a cutting for a back side 13 of the hand, wherein a sewed-in element 18 provides the rest of the wideness. The element 18 is provided for at the complete thumb 5, in the illustrated embodiment, however, it extends basically only to the region underneath of the knuckles of the forefinger.

The element 18 is connected to the inner side 12 of the hand by means of a thumb-seam 19 which is formed here as a lap seam. In this lap seam the materials of the element 18 and of the inner side 12 of the hand are stitched upon each other right-side onto left-side, so that in the region of the lap seam 19 there exist only two layers of material.

The element 18 may be connected to the back side 13 of the hand by a usual inseam 14, i.e. a seam at which the materials are laid together right-side upon right-side and are seamed with a distance to the cut selvedge. As is illustrated, if the element 18 does not extend into the forefinger 6, the inner side 12 of the hand is cut broader in the region of the forefinger 6 than the back side 13 of the hand, so that the inner side 12 of the hand forms a larger portion of the circumference of the finger 6 as compared to the back side 13 of the hand. In the same way the back side 13 of the hand may be cut smaller in the region of the thumb 5 as compared to the inner side 12 of the hand, so that the seam 14 between the thumb 5 and the adjacent finger 6 is relocated towards the back side 13 of the hand.

A padding 17 for padding the ball of the thumb extends by a region 17*a* to this fastening seam 14, so that at least the thumb-seam 19 which abuts on the inner side 12 of the hand is covered. In the same way as is the case with the first embodiment the padding 17*a* covers the region of load due to the grip within the thumb crotch B by a width b. Further, the padding 17*a* may extend such onto the back side of the hand that also seam 14 is covered.

Also in this embodiment the padding 17 consists of those padding materials which have already been mentioned in connection with the first embodiment and—as is also the case there—preferably of a foamed material or a gel material, is arranged at the palm side of the glove, which is facing the hand, optionally covered by a separate piece of lining or by a complete glove-lining.

Between the individual fingers provided for are elements 20 and trims, respectively, which are sewed each with the inner side 12 of the hand and the back side 13 of the hand, respectively.

In a modification of the disclosed and illustrated embodiments the padding(s) may, if it is advantageous, extend considerably further onto the back side of the hand other than is illustrated in the figures. By the inventive padding the element between thumb and fingers may be fastened all around by inseams, wherein the padding entails that despite of these relatively voluminous seams no pressure spots may occur. Further, it is possible to cover the thumb-seam and the thumb-seams, respectively, by a padding which is separated from the usual padding and to provide for such a padding only in the region of the thumb-seam, respectively. Finally, the inventive padding can be utilized with other glove-patterns, such as gloves with outer seams or seamless gloves, or with gloves adapted for different purposes of use, such as worker's gloves, gloves for weightlifters, gloves for skiers, etc.

The invention claimed is:

1. A glove having an interior region and an exterior region, wherein the glove comprises:

a thumb;

a forefinger;

a thumb crotch positioned between the thumb and the forefinger, and having a region of grip load between the thumb and the forefinger, an element extending from the thumb crotch into the forefinger and the thumb, and having a seam; and a padding comprising a material selected from the group consisting of a foamed material, a gel, a latex material, and a rubber material, wherein the padding is fastened in the region of grip-load of the thumb crotch so that 1) the padding extends though the curvature of the thumb crotch into the dorsal side of the glove; and 2) the padding is positioned on the interior region of the glove such that upon insertion of a hand within the glove the padding is in contact with the hand; and wherein the padding covers the region of the element positioned within the thumb crotch.

2. Glove according to claim 1, characterized in that the padding covers at least one seam.

3. Glove according to claim 1, characterized in that the padding is partial padding.

4. Glove according to claim 1, characterized in that the padding is an extended region of a padding for a ball region on the thumb.

5. Glove according to claim 1, characterized in that the padding comprises a lining material that covers the padding material.

6. Glove according to claim 2, characterized in that the seam is formed as a lap seam.

7. Glove according to claim 2, characterized in that the seam is an inseam.

8. Glove according to claim 1, wherein upon application of the glove onto a user's hand, the padding is in direct contact with the user's skin.

9. Glove according to claim 1, wherein the glove is designed for use in a sports activity.

10. Glove according to claim 9, wherein the sports activity is bicycling.

11. Glove according to claim 1, wherein the glove is a 5-finger glove.

12. Glove according to claim 1, wherein the glove is designed for use in bicycling.

13. Glove according to claim 1, wherein the padding extends through the curvature of the thumb crotch into the middle of the dorsal side of said glove.

14. A glove having an interior region and an exterior region, wherein the glove comprises:

a thumb;

a forefinger;

a thumb crotch positioned between the thumb and the forefinger, and having a region of grip load between the thumb and the forefinger, an element extending from the thumb crotch into the forefinger and the thumb, and having a seam, and a padding fastened in the region of grip-load of the thumb crotch so that 1) the padding extends though the curvature of the thumb crotch into the dorsal side of the glove; 2) covers only the curvature of the thumb crotch from a position at or below the base of the forefinger to the base of the thumb; and 3) the padding is positioned on the interior region of the glove such that upon insertion of a hand within the glove the padding is in contact with the hand;

wherein the padding covers the region of the element positioned within the thumb crotch.

15. Glove according to claim 14, wherein the padding comprises a material selected from the group consisting of a foamed material, a gel, a latex material, and a rubber material.

16. Glove according to claim 14, characterized in that the padding comprises a lining material that covers the padding material.

* * * * *

UNITED STATES PATENT AND TRADEMARK OFFICE

CERTIFICATE OF CORRECTION

PATENT NO. : 7,469,426 B2
APPLICATION NO. : 10/878813
DATED : December 30, 2008
INVENTOR(S) : Stefan Roeckl It is certified that error appears in the above-identified patent and that said Letters Patent is hereby corrected as shown below:

ON THE TITLE PAGE:

After Item: [76] "Inventor: Stefan Roeckl, Walchstadter Hohe 7, 82057 Icking (DE)"

Insert: --[73] Assignee: Roeckl Sporthandschuhe GmbH & Co. KG (DE)--

After Item: [65] "Prior Publication Data
US 2005/0028244 A1 Feb. 10, 2005"

Insert: --[30] Foreign Application Priority Data
July 1, 2003 (DE).....203 10 088.3--

Signed and Sealed this

Twenty-first Day of December, 2010

David J. Kappos

David J. Kappos
*Director of the United States Patent and Trademark Office*